United States Patent [19]

Lewis

[11] 3,982,090

[45] Sept. 21, 1976

[54] DETENT COMPONENT

[75] Inventor: Keith Lewis, Burnley, England

[73] Assignee: The Lucas Electrical Company Limited, Birmingham, England

[22] Filed: June 2, 1975

[21] Appl. No.: 582,940

[30] Foreign Application Priority Data

June 14, 1974 United Kingdom ..... 26433/74

[52] U.S. Cl. ..... 200/291; 200/153 J; 200/67 G

[51] Int. Cl.[2] ..... H01H 13/38

[58] Field of Search ..... 200/291, 67 G, 153 J; 74/567

[56] References Cited

UNITED STATES PATENTS

| | | | |
|---|---|---|---|
| 3,287,513 | 11/1966 | McFarland | 200/291 |
| 3,639,714 | 2/1972 | Fujimoto et al. | 200/153 J |

FOREIGN PATENTS OR APPLICATIONS

| | | | |
|---|---|---|---|
| 1,300,603 | 8/1969 | Germany | 200/291 |

*Primary Examiner*—Herman J. Hohauser
*Attorney, Agent, or Firm*—Holman & Stern

[57] ABSTRACT

A detent component for use in a detent assembly of the kind capable of latching a linearly movable member in a predetermined position relative to a fixed member includes a mounting piece whereby the component can be secured to either the movable or the fixed member of a pair of relatively linearly movable members. Additionally, there is a cam follower carried by the mounting piece which is engageable with a detent cam form on the other of the pair of members. The cam follower is defined by an upturned end region of a first limb of a hairpin type spring the second limb of which engages a stop on the mounting piece. The junction region of the first and second limbs defining a loop encircling an anchor post on the mounting piece and the first limb abutting a pair of spaced abutments on the mounting piece. The pair of abutments are positioned so that in use they are aligned parallel to the direction of relative movement of the members, and the resilience of the spring causes the first limb to engage the abutments so that the abutments define a rest position of the limb which, in use, is parallel to the direction of relative movement of the members.

2 Claims, 7 Drawing Figures

DETENT COMPONENT

This invention relates to a detent component for use in a detent assembly of the kind capable of latching a linearly movable member in a predetermined position relative to a fixed member.

A detent component according to the invention includes a mounting piece whereby the component can be secured to either the movable or the fixed member of a pair of relatively linearly movable members, and a cam follower carried by said mounting piece and engageable with a detent cam form on the other of said pair of members, said cam follower being defined by an upturned end region of a first limb of a hairpin type spring the second limb of which engages a stop on said mounting piece, the junction region of the first and second limbs defining a loop encircling an anchor post on the mounting piece and said first limb abutting a pair of spaced abutments on the mounting piece, said pair of abutments being positioned so that in use they are aligned parallel to the direction of relative movement of said members, and the resilience of the spring causing said first limb to engage said abutments so that the abutments define a rest position of said limb, in use, parallel to said direction of relative movement.

Figure 1:
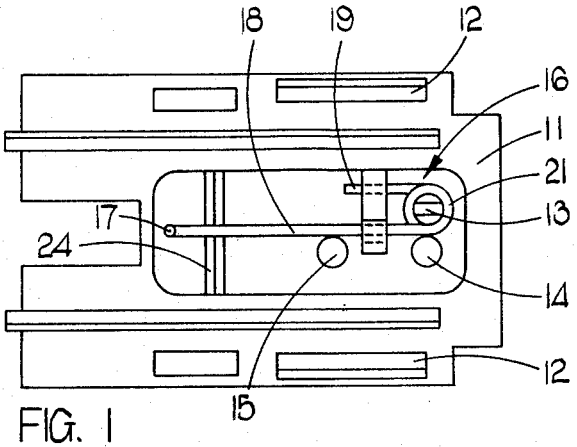
Figure 2:
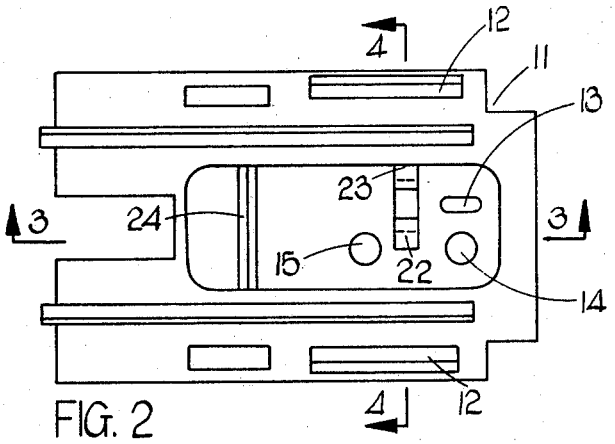
Figure 4:
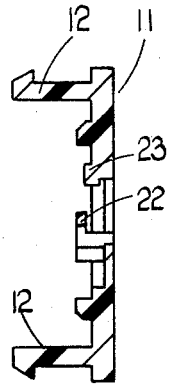
Figure 3:
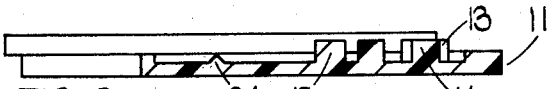
Figure 5:
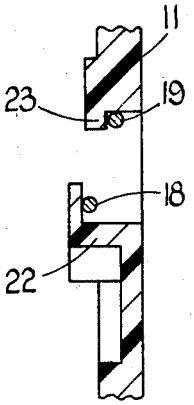
Figure 6:
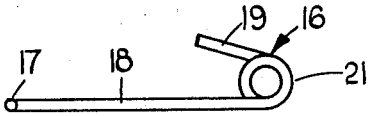
Figure 7:
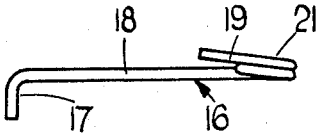

One example of the invention is illustrated in the accompanying drawings wherein, FIG. 1 is a plan view of a detent component, FIG. 2 is a view similar to FIG. 1 but with the cam follower and associated spring omitted, FIGS. 3 and 4 are sectional views on the lines 3—3 and 4—4 respectively in FIG. 2, FIG. 5 is an enlargement of part of FIG. 4, and FIGS. 6 and 7 are plan, and side elevational views respectively of the cam follower and spring seen in plan in FIG. 1.

Referring to the drawings, the detent component is intended for use in a detent assembly for an electrical switch where the movable member of the switch moves linearly relative to the body of the switch.

The movable member of the switch can occupy a first, rest position relative to the body, the movable member being urged to the rest position by a spring acting between the movable member and the body. The first, rest position is conveniently defined by abutments on the body and the movable member. The movable member can also occupy a second, operative position relative to the body where the movable member is moved relative to the body against the action of the return spring, and wherein electrical contacts of the switch are operated. The detent arrangement latches the movable member in the operative position, and the detent arrangement includes a cam follower carried by the body of the switch and a cam form carried by the movable member of the switch and engaged by the cam follower. The cam follower rides in a channel in the cam form, and during movement from the rest position to the operative position the cam follower is caused to move laterally against a centering bias, and ultimately springs back under the action of the centering bias to enter a recess in the cam form to latch the movable member in its operative position. During release of the member from its operative position the movable member is moved beyond its operative position to release the cam follower from the recess, whereupon the cam follower moves further laterally under the action of its centering force to clear the recess, and permit the movable member, when released to return toits rest position under the action of the return spring.

Detent arrangements of the form described above are well known, and require no further explanation.

The detent component forming one example of the present invention, and shown in the drawings, comprises a moulded synthetic resin mounting piece 11 generally of plate like form. Upstanding from one face of the mounting piece 11 are a pair of resilient, barbed arms 12 whereby the component can be engaged as a snap fit with the fixed member, or body, of a switch. Upstanding from the mounting piece 11, and generally mid-way between the arms 12 is an anchor post 13 of strip like form, the anchor post 13 having its width dimension parallel to the length of the component, and thus parallel to the direction of relative movement between the switch movable member and the switch body in use. Displaced laterally from the anchor post 13, and upstanding from the mounting piece 11 is a first abutment 14 and longitudinally spaced from the abutment 14 is a second, similar abutment 15. The abutments 15 are aligned parallel to the length of the component.

The cam follower is defined by an upturned end region of a first limb 18 of a hairpin type wire spring 16. The second limb 19 of the spring 16 is considerably shorter than the limb 18, and at the junction of the limbs 18, 19 the wire forming the spring 16 is wound to form a circular loop 21 which encircles the anchor post 13, and in winding the wire of the spring 16 to define the loop 21 a helix is produced. Thus the limb 19 lies in a plane below the plane of the limb 18. In order to retain the spring 16 on the mounting piece 11 the mounting piece 11 is integrally formed with a pair of under cut lugs 22, 23 the limb 18 lying in the undercut region of the lug 22 and the limb 19 lying in the undercut region of the limb 23, the under cut regions of the limbs 22, 23 being shaped to accommodate the difference in level of the limbs 18, 19. The natural, unstressed condition of the spring 16 is shown in FIG. 6, from which it will be appreciated that the limbs 18, 19 in their unstressed condition are not parallel. However, in order to assemble the spring 16 to the mounting piece 11 the limbs must be flexed towards one another, and thus the spring is stressed when in position on the mounting piece 11. The natural resilience of the spring 16 urges the limbs 18, 19 apart, but such movement of the limbs 18, 19 is prevented by abutment of the limb 19 with the lug 23, and abutment of the limb 18 with the abutments 14, 15. Thus the abutments 14, 15 define the rest position of the limb 18, and it will be seen that in the rest position the limb 18 is aligned parallel to the length of the component, and accordingly in use will be aligned parallel to the direction of relative movement of the switch movable member and body.

Lateral movement of the cam follower 17 during use of the switch embodying the detent component can of course take place in either direction. However, the arrangement is so chosen that the principal movement takes place in a direction to flex the limb 18 away from the abutment 15. Thus during flexure in this direction the effective flexing length of the limb 18 is the actual length of the limb 18 and the abutments 14, 15 do not impede the limb 18, nor shorten its effective length. When flexing in the opposite direction of course the effective length of the limb 18 is the length between the free end of the limb 18 and the abutment 15 but of course this very minor disadvantage is even further minimized by arranging for the principal lateral movement of the limb to be in the direction away from the abutments. A transverse rib 24 of triangular cross-section supports the limb 18 against movement at right angles to the plane of the mounting piece 11 in use.

The anchor post 13 is of non-circular, in this case strip-like, form in order to minimize the risk of the loop 21 binding on the post during flexure of the limb 18, as can occur in an arrangement where the anchor post is of circular cross-section, and a close fit in the loop. The use of the strip-like post 13 thus introduces a small degree of lateral play into the anchorage of the loop region of the spring, and it is for this reason that it is necessary to utilize the pair of spaced abutments 14, 15 to align the limb 18 as desired in its rest position.

I claim:

1. A detent component for use in a detent assembly of the kind capable of latching a linearly movable member in a predetermined position relative to a fixed member, the component including a mounting piece whereby the component can be secured to either the movable or the fixed member of a pair of relatively linearly movable members, and a cam follower carried by said mounting piece and engageable with a detent cam form on the other of said pair of members, said cam follower being defined by an upturned end region of a first limb of a hairpin type spring the second limb of which engages a stop on said mounting piece, the junction region of the first and second limbs defining a loop encircling an anchor post on the mounting piece and said first limb abutting a pair of spaced abutments on the mounting piece, said pair of abutments being positioned so that in use they are aligned parallel to the direction of relative movement of said members, and the resilience of the spring causing said first limb to engage said abutments so that the abutments define a rest position of said limb, in use, parallel to said direction of relative movement.

2. An electrical switch utilizing a detent component as claimed in claim 1.

* * * * *